US011767812B1

(12) United States Patent
Lohr et al.

(10) Patent No.: US 11,767,812 B1
(45) Date of Patent: Sep. 26, 2023

(54) INTAKE MANIFOLD AND CORRESPONDING FUEL SYSTEM FOR A VEHICLE

(71) Applicant: FORD GLOBAL TECHNOLOGIES, LLC, Dearborn, MI (US)

(72) Inventors: John Carl Lohr, Beverly Hills, MI (US); Christopher K. Palazzolo, Ann Arbor, MI (US); Nolan Dickey, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/948,495

(22) Filed: Sep. 20, 2022

(51) Int. Cl.
*F02M 25/08* (2006.01)
*F02M 35/10* (2006.01)

(52) U.S. Cl.
CPC .. *F02M 25/0836* (2013.01); *F02M 35/10222* (2013.01); *F02M 35/10262* (2013.01)

(58) Field of Classification Search
CPC ..... F02M 25/0836; F02M 35/10222; F02M 35/10262
See application file for complete search history.

(56) References Cited

U.S. PATENT DOCUMENTS

2012/0234303 A1 9/2012 Born et al.
2016/0153409 A1* 6/2016 Sudo ..... F02M 35/104 123/184.61
2018/0087476 A1* 3/2018 Amemiya ..... F02B 37/24
2021/0172410 A1* 6/2021 Kim ..... F02M 25/0836

FOREIGN PATENT DOCUMENTS

DE 102019205175 A1 10/2020
JP 2013144929 A 7/2013

* cited by examiner

*Primary Examiner* — Xiao En Mo
(74) *Attorney, Agent, or Firm* — Vincent Mastrogiacomo; Brooks Kushman P.C.

(57) ABSTRACT

An intake manifold for an engine includes an air inlet port and a false wall. The air inlet port has an interior surface partially defining a channel. The false wall also partially defines the channel. The false wall is flush with the interior surface. A chamber is defined on an opposing side of the false wall relative to the channel. A gap is defined between outer edges of the false wall and the interior surface. The gap establishes fluid communication between the chamber and the channel. The air inlet port defines an orifice configured to establish fluid communication between a fuel evaporative recovery system and the chamber.

20 Claims, 5 Drawing Sheets

INTAKE MANIFOLD AND CORRESPONDING FUEL SYSTEM FOR A VEHICLE

TECHNICAL FIELD

The present disclosure relates to fuel systems for vehicles.

BACKGROUND

Vehicles may include fuel systems that are configured to deliver fuel from a fuel tank to an internal combustion engine.

SUMMARY

A vehicle includes an engine, a fuel tank, a canister, an intake manifold, a purge valve, and a controller. The engine is configured to propel the vehicle. The fuel tank is configured to store fuel. The canister is in fluid communication with the fuel tank. The canister is configured to receive and store evaporated fuel from the fuel tank. The intake manifold is configured to direct air to the engine and has an inlet conduit that defines a channel configured to receive air from a throttle. The inlet conduit has a primary wall partially defining the channel and a secondary wall partially defining the channel. The secondary wall overlaps and is offset from a first portion of the primary wall such that a chamber is defined between a radially outward facing surface of the secondary wall and a radially inward facing surface of the primary wall along the first portion of the primary wall and such that a gap is defined between an outer periphery of the secondary wall and a second portion of the primary wall. The gap establishes fluid communication between the chamber and the channel. The purge valve is disposed between the canister and the intake manifold. The purge conduit is configured to establish fluid communication between the purge valve and the chamber. The controller is programmed to, in response to a command to purge the canister of evaporated fuel, open the purge valve and direct the evaporate fuel to the chamber via the purge conduit.

An intake manifold for an engine includes a conduit, a throttle body mounting flange, a primary wall, and a secondary wall. The conduit includes the primary wall, which partially defines an air intake channel. The throttle body mounting flange protrudes radially outward from an end of the conduit, defines an opening to the air intake channel, and is configured to receive a throttle body for installation thereon. The secondary wall partially defines the air intake channel. The secondary wall is offset from the primary wall such that a chamber is defined between an exterior side of the secondary wall and an interior side of the primary wall and such that a gap is defined between outer edges of the secondary wall and inner edges of the primary wall. The gap establishes fluid communication between the chamber and the channel. The conduit defines an orifice configured to establish fluid communication between a fuel evaporative storage canister and the chamber.

An intake manifold for an engine includes an air inlet port and a false wall. The air inlet port has an interior surface partially defining a channel. The false wall also partially defines the channel. The false wall is flush with the interior surface. A chamber is defined on an opposing side of the false wall relative to the channel. A gap is defined between outer edges of the false wall and the interior surface. The gap establishes fluid communication between the chamber and the channel. The air inlet port defines an orifice configured to establish fluid communication between a fuel evaporative recovery system and the chamber.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
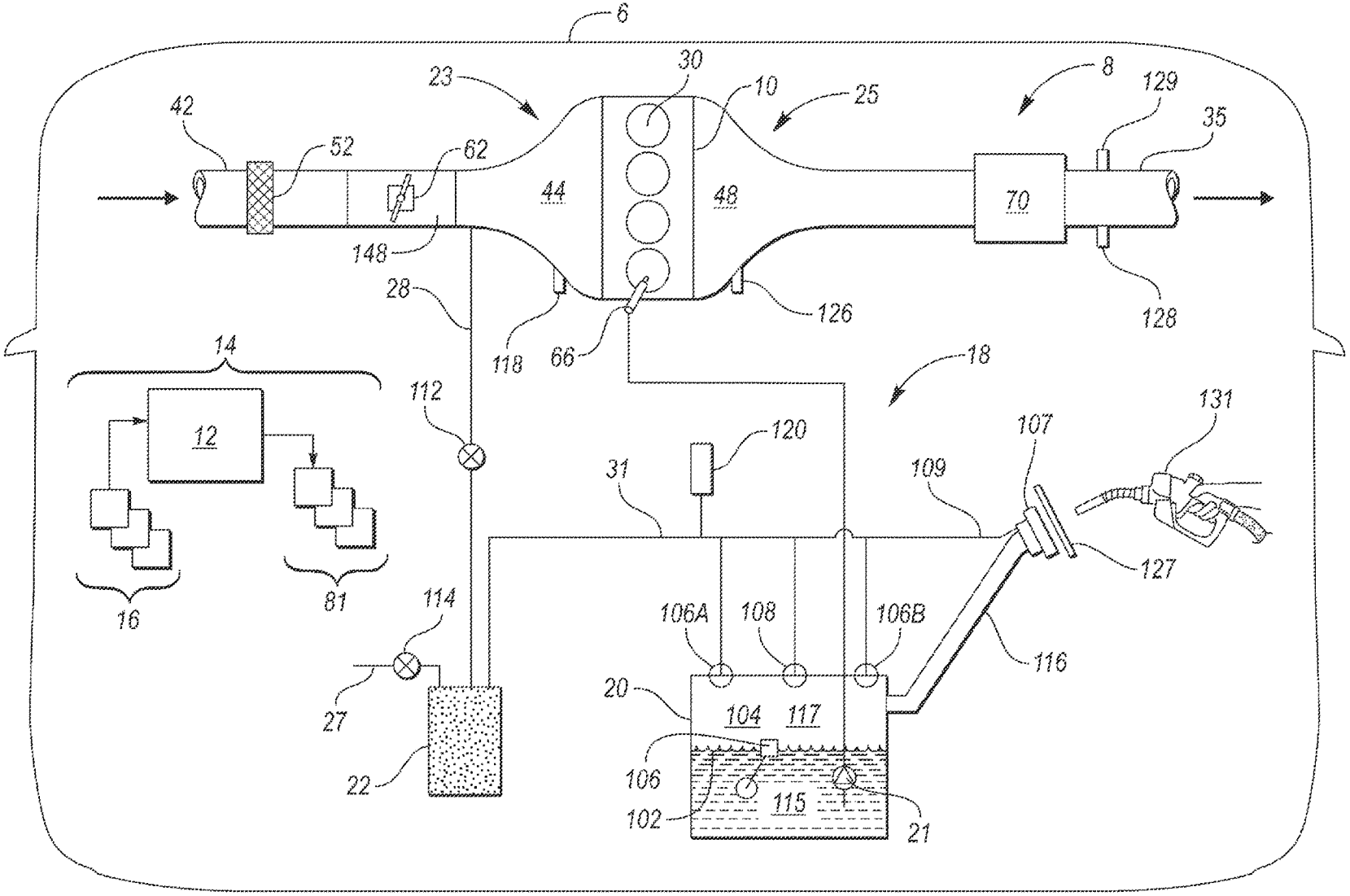
FIG. 1 is a schematic illustration of a vehicle and a fuel system for the vehicle.
Figure 2:
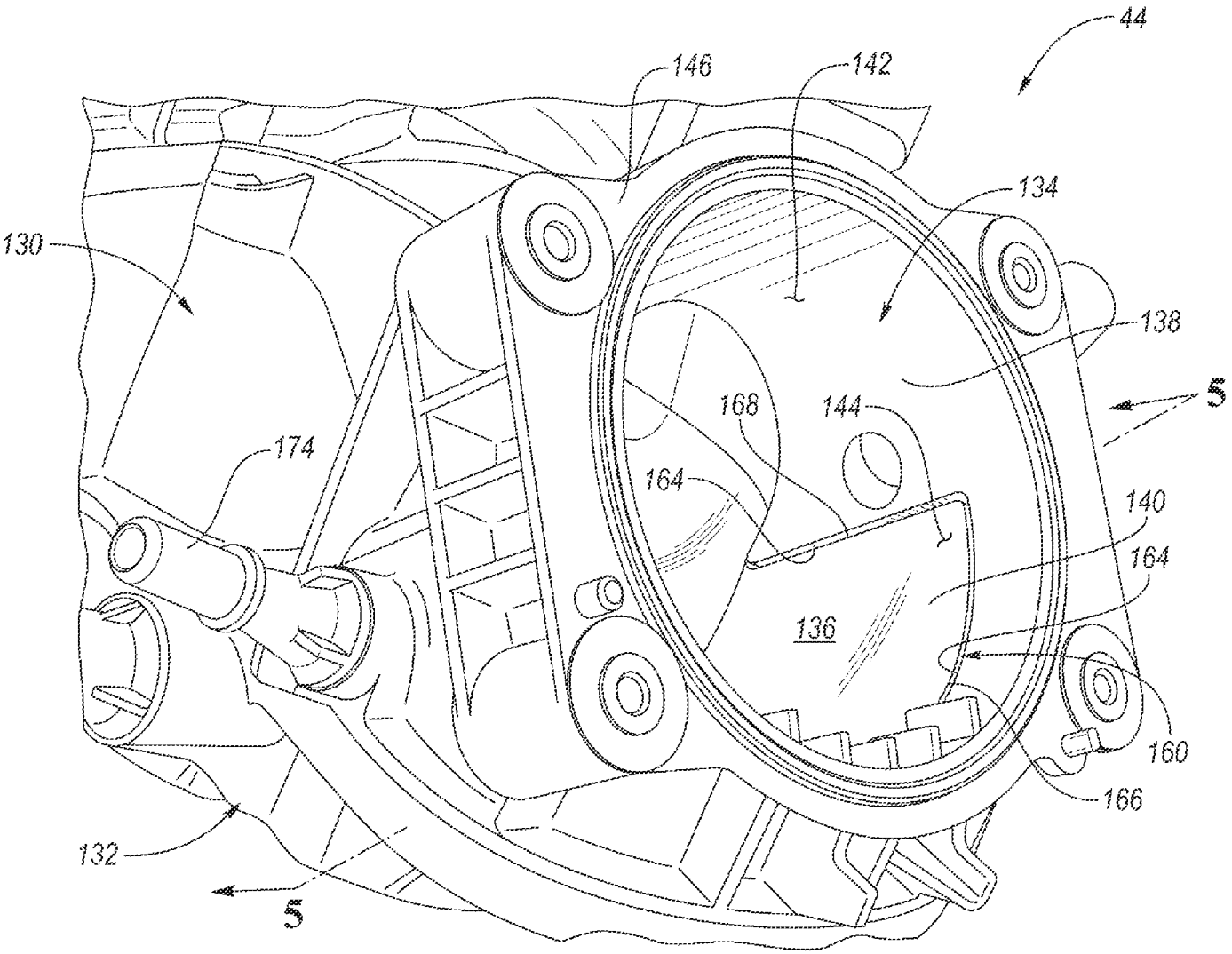
FIG. 2 is a partial front isometric view of the engine intake manifold including a throttle body mounting flange.
Figure 3:
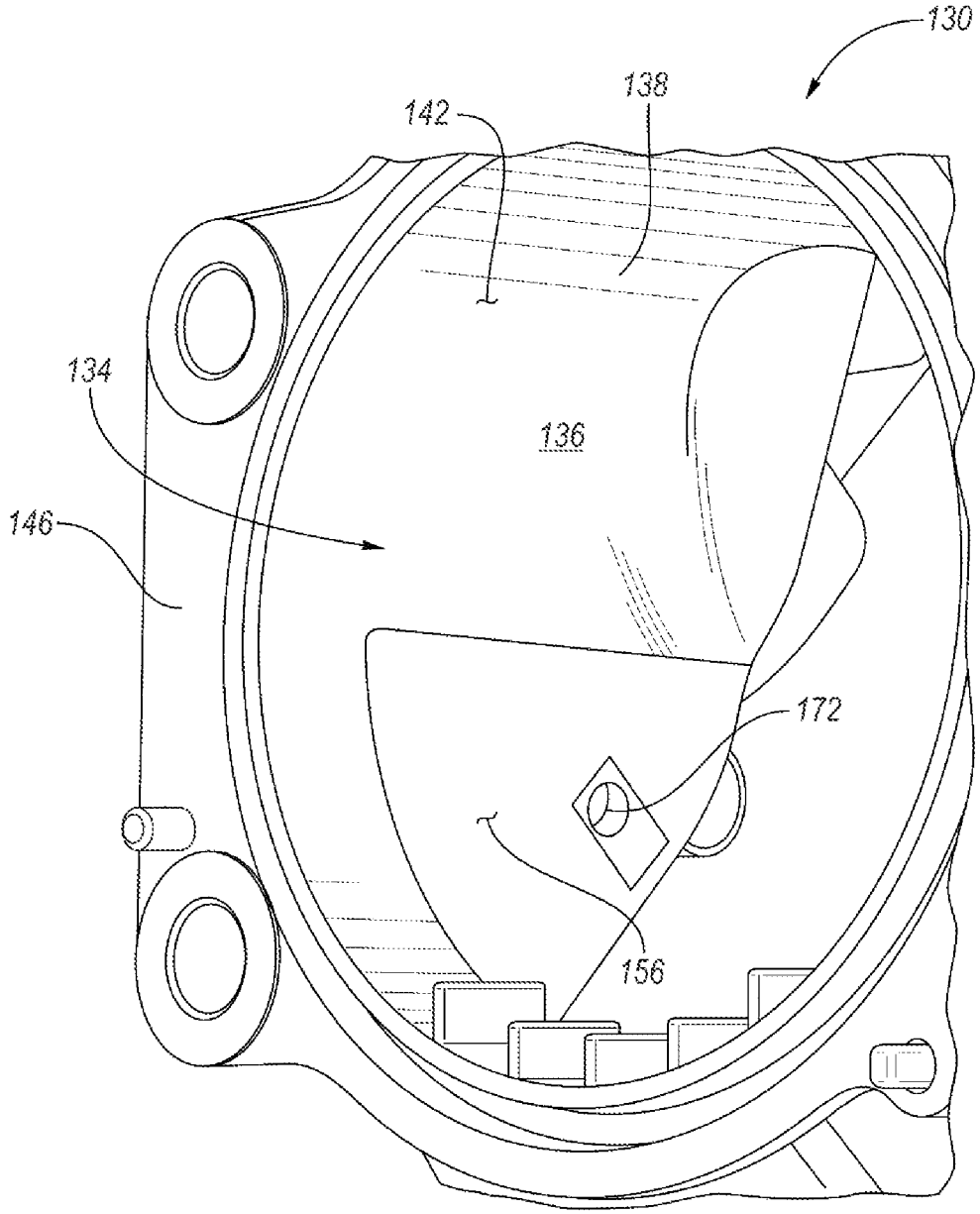
FIG. 3 is a partial front isometric view of an upper portion of the engine intake manifold including the throttle body mounting flange.
Figure 4:
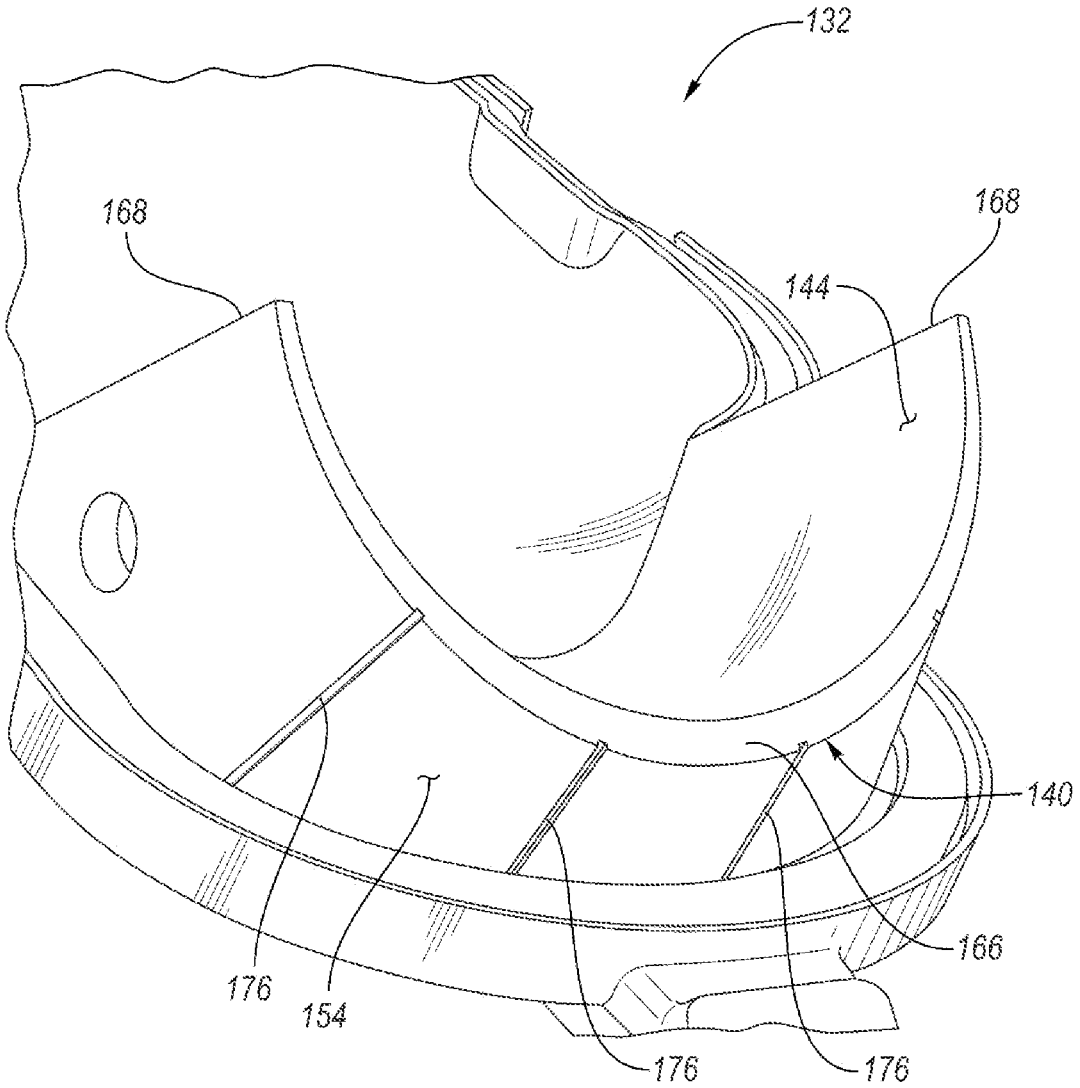
FIG. 4 is a partial front isometric view of a lower portion of the engine intake manifold.
Figure 5:
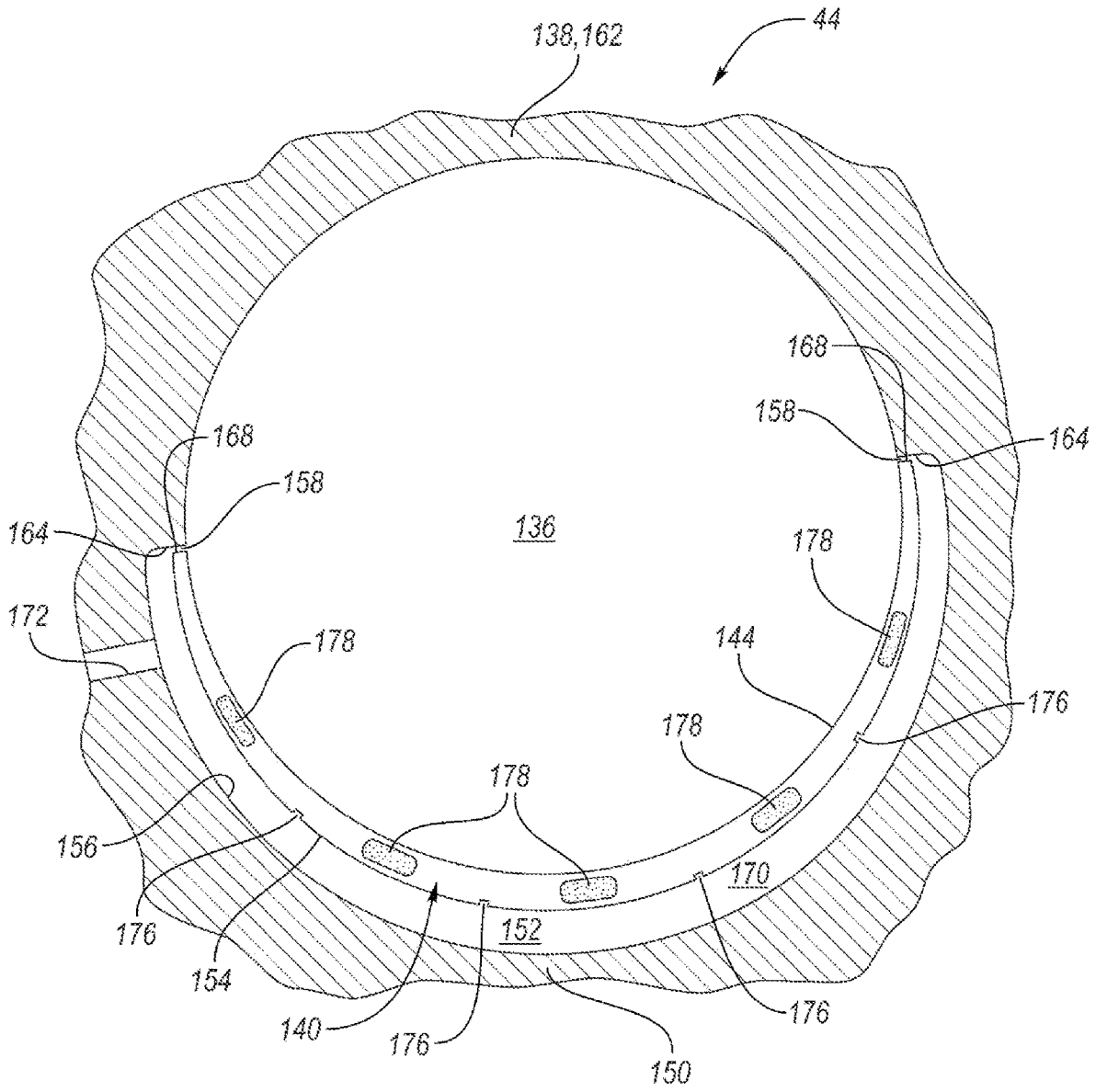
FIG. 5 is a cross-sectional view taken along line 5-5 in FIG. 2.

FIG. 1 shows a schematic depiction of a vehicle 6, an engine system 8, and a fuel system 18. The fuel system 18 may more specifically be a fuel delivery system for an engine 10. The vehicle 6 may be a hybrid vehicle, such as a hybrid electric vehicle. A hybrid electric vehicle may derive propulsion power from the engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device. Alternatively, the vehicle 6 may be a non-hybrid vehicle, such as a conventional internal combustion engine vehicle.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices 70 may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

When configured as a hybrid vehicle, the vehicle may be operated in various modes. The various modes may include a full hybrid mode or battery mode, wherein the vehicle is driven by power from only the battery. The various modes may further include an engine mode wherein the vehicle is propelled with power derived only from the combusting engine. Further, the vehicle may be operated in an assist or mild hybrid mode wherein the engine is the primary source of torque and the battery selectively adds torque during specific conditions, such as during a tip-in event. A controller may shift vehicle operation between the various modes of operation based at least on vehicle torque/power requirements and the battery's state of charge. For example, when the power demand is higher, the engine mode may be used to provide the primary source of energy with the battery used selectively during power demand spikes. In comparison, when the power demand is lower and while the battery is sufficiently charged, the vehicle may be operated in the battery mode to increase vehicle fuel economy. Further, as elaborated herein, during conditions when a fuel tank vacuum level is elevated, the vehicle may be shifted from the engine mode of operation to the battery mode of operation to enable excess fuel tank vacuum to be vented to the engine's intake manifold without causing air-fuel ratio disturbances.

Engine system 8 is coupled to the fuel system 18. The fuel system 18 includes a fuel tank 20 coupled to a fuel pump 21, and a fuel vapor storage device or canister 22. The fuel system 18 may also include a second or secondary fuel vapor storage device or canister (not shown). The second fuel vapor canister may be referred to as the buffer fuel vapor canister and is configured to provide additional storage space for when the fuel vapor canister 22 has no further capacity to store fuel vapors. The fuel tank 20 supplies fuel to the engine 10 which propels the vehicle 6. The canister 22 is part of an evaporative emissions system or fuel evaporate recovery system that prevents fuel vapors from being released into the environment. The evaporative emissions system or fuel evaporate recovery system may include the canister 22, purge line 28, the canister purge valve 112, the canister vent valve 114, vent 27, conduit 31, the one or more pressure sensors 120, vapor line 109, the refueling inlet 107, vent valve 106A, vent valve 106B, and vent valve 108.

Fuel tank 20 receives fuel via a refueling line 116, which acts as a passageway between the fuel tank 20 and a refueling door 127 on an outer body of the vehicle. During a fuel tank refueling event, fuel may be pumped into the vehicle from an external source through refueling inlet 107 that is in fluid communication with refueling line 116. Fueling inlet 107 may be covered by a gas cap or may be capless. Vent valves 106A, 106B, 108 (described below in further details) may be open to recover fuel vapors (i.e., fuel that has been vaporized into a gaseous form) from a vapor space 104 within the fuel tank 20 during a refueling event where a refueling nozzle 131 is directing liquid fuel into the fuel tank via the refueling line 116. The fuel tank 20 may be configured to store both liquid fuel 115 and vaporized fuel 117. The refueling line 116 may be referred to as a fluid flow path that is configured to facilitate flow of liquid fuel into the fuel tank 20 from the refueling nozzle 131.

The fuel tank 20 may hold a plurality of fuel blends, including fuel with a range of alcohol contents, such as various gasoline-ethanol blends, including E10, E85, gasoline, etc., and combinations thereof. A fuel level sensor 106 located in fuel tank 20 may provide an indication of the fuel level ("Fuel Level Input") to a controller 12. As depicted, fuel level sensor 106 may comprise a float connected to a variable resistor. Alternatively, other types of fuel level sensors may be used.

A fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system.

In some embodiments, engine 10 may be configured for selective deactivation. For example, engine 10 may be selectively deactivatable responsive to idle-stop conditions. Therein, responsive to any or all of idle-stop conditions being met, the engine 10 may be selectively deactivated by deactivating cylinder fuel injectors. As such, idle-stop conditions may be considered met if the engine 10 is combusting while a system battery (or energy storage device) is sufficiently charged, if auxiliary engine loads (e.g., air conditioning requests) are low, engine temperatures (intake temperature, catalyst temperature, coolant temperature, etc.) are within selected temperature ranges, and a driver requested torque or power demand is sufficiently low. In response to idle-stop conditions being met, the engine may be selectively and automatically deactivated via deactivation of fuel and spark. The engine may then start to spin to rest. Further, as elaborated herein, during conditions when fuel tank vacuum is elevated, the engine may be actively pulled-down, or deactivated, so as to enable the fuel tank vacuum to be vented to the deactivated engine.

The canister 22 is in fluid communication with the fuel tank 20 such that fuel vapors generated in fuel tank 20 may be routed to and stored in the canister 22, via conduit 31, before being purged to engine intake 23. Fuel tank 20 may include one or more vent valves for venting fuel vapors generated in the fuel tank 20 to canister 22 via conduit 31. Conduit 31 may also be referred to as a fluid flow path that is configured to facilitate flow of the vaporized fuel and establish fluid communication between the fuel tank 20 and the canister 22. Conduit 31 may also be in fluid commination with the refueling inlet 107 via vapor line 109. The one or more vent valves may be electronically or mechanically actuated valves and may include active vent valves (that is, valves with moving parts that are actuated open or close by a controller) or passive valves (that is, valves with no moving parts that are actuated open or close passively based on a tank fill level). In the depicted example, fuel tank 20 includes gas vent valves (GVV) 106A, 106B at either end of fuel tank 20 and a fuel level vent valve (FLVV) 108, all of which are passive vent valves. Each of the vent valves 106A, 106B, 108 may include a tube (not shown) that dips to a varying degree into a vapor space 104 of the fuel tank. Based on a fuel level 102 relative to vapor space 104 in the fuel tank, the vent valves may be open or closed. For example, GVV 106A, 106B may dip less into vapor space 104 such that they are normally open. This allows diurnal and "running loss" vapors from the fuel tank to be released into canister 22, preventing over-pressurizing of the fuel tank. As another example, FLVV 108 may dip further into vapor space 104 such that it is normally open. This allows fuel tank overfilling to be prevented. In particular, during fuel tank refilling, when a fuel level 102 is raised, vent valve 108 may close, causing pressure to build in vapor line 109 (which is downstream of refueling inlet 107 and coupled thereon to conduit 31) as well as at the refueling nozzle 131 that is coupled to the fuel pump. The increase in pressure at the refueling nozzle 131 may then trip the refueling pump, stopping the fuel fill process automatically, and preventing overfilling.

It will be appreciated that while the depicted embodiment shows vent valves 106A, 106B, 108 as passive valves, in alternate embodiments, one or more of them may be configured as electronic valves electronically coupled to a controller (e.g., via wiring). Therein, a controller may send a signal to actuate the vent valves to open or close. In addition, the valves may include electronic feedback to communicate an open/close status to the controller. While the use of electronic vent valves having electronic feedback may enable a controller to directly determine whether a vent valve is open or closed (e.g., to determine if a valve is closed when it was supposed to be open), such electronic valves may increase the price of the fuel system.

The canister 22 is filled with an appropriate adsorbent for temporarily trapping fuel vapors (including vaporized hydrocarbons) via adsorption that are generated in the fuel tank 20. In one example, the adsorbent used is activated charcoal. When purging conditions are met, such as when the canister 22 is saturated, vapors stored in the canister 22 may be purged via desorption to engine intake 23, specifically intake manifold 44, via purge line 28 by opening canister purge valve 112 during vehicle operated (e.g., while the engine 10 is running). The canister 22 is in fluid communication with the engine 10 via purge line 28. The canister purge valve 112 is disposed between the canister 22 and the engine 10 and is configured to direct the evaporated fuel from the canister 22 to the engine 10 when open. More specifically, the canister purge valve 112 is disposed between the canister 22 and the engine intake manifold 44, and is configured to direct the evaporated fuel from the canister 22 to the engine 10 via the engine intake manifold 44 when open.

While a single canister 22 is shown, it will be appreciated that fuel system 18 may include any number of canisters between the fuel tank 20 and the engine 10. In one example, canister purge valve 112 may be a solenoid valve wherein opening or closing of the valve is performed via actuation of a canister purge solenoid.

Canister 22 includes a vent 27 (herein also referred to as a fresh air line) for routing gases out of the canister 22 to the atmosphere when storing, or trapping, fuel vapors from fuel tank 20. Vent 27 may also allow fresh air to be drawn into canister 22 when purging stored fuel vapors to engine intake 23 via purge conduit or purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve 114 may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve 114 may be opened to allow a flow of fresh air to strip the fuel vapors stored in the canister 22. By closing canister vent valve 114, the fuel tank 20 may be isolated from the atmosphere.

One or more pressure sensors 120 may be coupled to fuel system 18 for providing an estimate of a fuel system pressure (e.g., the pressure of the liquid and/or evaporated fuel in the fuel system 18). The one or more pressure sensors 120 are configured to communicate the fuel system pressure to controller 12. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 coupled to conduit 31 between the fuel tank and canister 22, in alternate embodiments, the pressure sensor 120 may be directly coupled to fuel tank 20 or the canister 22.

Fuel vapors released from canister 22, for example during a purging operation, may be directed into engine intake manifold 44 via purge line 28. The flow of vapors along purge line 28 may be controlled by canister purge valve 112, coupled between the fuel vapor canister and the engine intake. The quantity and rate of vapors released by the canister purge valve 112 may be determined by the duty cycle of an associated canister purge valve solenoid (illustrated in further detail below). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake.

An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode wherein the controller 12 may close canister purge valve (CPV) 112 and open canister vent valve 114 to direct refueling and diurnal vapors into canister 22 while preventing fuel vapors from being directed into the intake manifold. As another example, the fuel system may be operated in a refueling mode (e.g., when fuel tank refueling is requested by a vehicle operator), wherein the controller 12 may maintain canister purge valve 112 closed, to depressurize the fuel tank before allowing enabling fuel to be added therein. As such, during both fuel storage and refueling modes, the fuel tank vent valves 106A, 106B, and 108 are assumed to be open.

As yet another example, the fuel system may be operated in a canister purging mode (e.g., after an emission control device light-off temperature has been attained and with the engine running), wherein the controller 12 may open canister purge valve 112 and open canister vent valve 114. Stated in more general terms, the controller 12 may be programmed to, in response to a command to purge the canister 22 of evaporated fuel, open the purge valve 112 and direct the evaporate fuel to the intake manifold 44. As such, during the canister purging, the fuel tank vent valves 106A, 106B, and 108 are assumed to be open (though is some embodiments, some combination of valves may be closed). During this mode, vacuum generated by the intake manifold of the operating engine may be used to draw fresh air through vent 27 and through canister 22 to purge the stored fuel vapors into intake manifold 44. In this mode, the purged fuel vapors from the canister 22 are combusted in the engine. The purging may be continued until the stored fuel vapor amount in the canister is below a threshold. During purging, the learned vapor amount can be used to determine the amount of fuel vapors stored in the canister 22, and then during a later portion of the purging operation (when the canister 22 is sufficiently purged or empty), the learned vapor amount can be used to estimate a loading state of the canister 22. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister 22). Based on the canister load, and further based on engine operating conditions, such as engine speed-load conditions, a purge flow rate may be determined.

The vehicle 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas (air-to-fuel ratio) sensor 126 located upstream of the emission control device, exhaust temperature sensor 128, MAP sensor 118, and exhaust pressure sensor 129. The exhaust gas sensor 126 may more specifically be an oxygen sensor that measures an oxygen content within the exhaust gas output of the engine 10. The oxygen content is then communicated to the controller 12, which determines if the air-to-fuel ratio is rich, lean, or stoichiometric based on the measured oxygen content within the exhaust gas output. Other sensors such as additional pressure, temperature, air-to-fuel ratio, and composition sensors may be coupled to various locations in the vehicle 6. As another example, the actuators may include fuel injector 66, canister purge valve 112, canister vent valve 114, and throttle 62. The control system 14 may include controller 12. The controller 12 may receive input data from the various sensors, process the input data, and trigger the actuators in response to the processed input data based on instruction or code programmed therein corresponding to one or more routines.

While illustrated as one controller, the controller 12 may be part of a larger control system and may be controlled by various other controllers throughout the vehicle 6, such as a vehicle system controller (VSC). It should therefore be understood that the controller 12 and one or more other controllers can collectively be referred to as a "controller" that controls various actuators in response to signals from various sensors to control functions the vehicle 6 or vehicle subsystems. The controller 12 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 12 in controlling the vehicle 6 or vehicle subsystems.

Control logic or functions performed by the controller 12 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based vehicle, engine, and/or powertrain controller, such as controller 12. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of a number of known physical devices which utilize electric, magnetic, and/or optical storage to keep executable instructions and associated calibration information, operating variables, and the like.

Referring to FIGS. 2-5, the intake manifold 44 is illustrated in further detail. The intake manifold includes an upper portion 130 and a lower portion 132. The intake manifold 44 also includes an air inlet port or air inlet conduit 134 that defines an air intake channel 136 configured to receive air from the throttle 62. More specifically, the air inlet conduit 134 may have a primary wall 138 that partially defines the channel 136 and a false or secondary wall 140 that partially defines the channel 136. The primary wall 138 may be part of the upper portion 130 while the secondary wall 140 may be part of the lower portion 132 such that the primary wall 138 is disposed along an upper half of the channel 136 while the secondary wall 140 is disposed along a lower half of the channel 136. Even more specifically, the primary wall 138 may have a first radially inward facing or first interior surface 142 that partially defines the channel 136 and the secondary wall 140 may have a second radially inward facing or second interior surface 144 that partially defines the channel 136. The first interior surface 142 of the primary wall 138 may be flush with the second interior surface 144 of the secondary wall 140 along the periphery or circumference of the channel 136. Alternatively, it may be understood that the air inlet port or air inlet conduit 134 only includes the primary wall 138 and that the false or secondary wall 140 is an additional component that is separate from the air inlet conduit 134 but that is secured or attached to the air inlet conduit 134.

A throttle body mounting flange 146 protrudes radially outward from an end of the conduit 134. The throttle body mounting flange 146 may be part of the upper portion 130. The throttle body mounting flange 146 defines an opening to the channel 136. The throttle body mounting flange 146 is configured to receive a throttle body 148 for installation thereon. The throttle body 148 may include the throttle 62 and a housing for the throttle 62.

The secondary wall 140 overlaps and is radially offset from a first portion 150 of the primary wall 138 such that a chamber 152 is defined between an exterior side or a radially outward facing surface 154 of the secondary wall 140 and an interior side or a radially inward facing surface 156 of the primary wall 138 along the first portion 150 of the primary wall 138. Inward facing surface 156 may be a portion of the first interior surface 142 of the primary wall 138. The chamber 152 is defined on an opposing side of the secondary wall 140 relative to the channel 136. A gap 158 is also defined between outer edges or an outer periphery 160 of the secondary wall 140 and a second portion 162 of the primary wall 138. More specifically, the gap 158 maybe defined between the outer edges or outer periphery 160 of the secondary wall 140 and inner edges 164 of the primary wall 138. The outer edges of the secondary wall 140 that define the gap may include a front edge 166 and side edges 168 of the secondary wall 140. It may also be said that the gap 158 is defined between the outer edges of the secondary wall 140 and the first interior surface 142 of the primary wall 138. The gap 158 establishes fluid communication between the chamber 152 and the channel 136.

The second interior surface 144 of the secondary wall 140 may more specifically be flush with the first interior surface 142 of the primary wall 138 along the second portion 162 of the primary wall 138 and may be offset and not flush with the first interior surface 142 of the primary wall 138 along first portion 150 of the primary wall 138. The first portion 150 of the primary wall 138 may also be offset from the second portion 162 of the primary wall 138 such that a radially outward extending recess 170 is defined by the first portion 150 of the primary wall 138. The secondary wall 140 may be disposed within the radially outward extending recess 170.

The purge conduit or purge line 28 may more specifically be configured to establish fluid communication between the canister purge valve 112 and the chamber 152. The air inlet port or air inlet conduit 134 defines an orifice 172 configured to establish fluid communication between the fuel evaporate recovery system (including the fuel evaporate storage canister 22) and the chamber 152. A fitting 174 (e.g., a spigot) that is secured to an end of the purge line 28 may be disposed within the orifice 172 to connect the purge line 28 to the chamber 152 and to established fluid communication between the fuel evaporate recovery system and the chamber 152 via purge line 28. The controller 12 may more specifically be programmed to, in response to a command to purge the canister 22 of evaporated fuel, open the purge valve 112 and direct the evaporated fuel to the chamber 152.

Even distribution of purge gases into the cylinders of the engine 10 increases the efficiency of combustion within the engine 10. The packing space for an intake manifold is limited. Therefore, finding an efficient position to direct the purged fuel vapors from the canister 22 to the intake manifold 44 becomes more difficult as the engine compartment spaces of vehicles decrease. Directing the purge gases (e.g., the vapors from the canister 22) to each cylinder of the engine also becomes more difficult. A single-entry point is desirable for packaging, expense, and weight purposes. However, directing the purged fuel vapors to each cylinder evenly becomes more difficult when a single-entry point is utilized. The use of the double wall area of an intake manifold (i.e., configuration of the primary wall 138 and the secondary wall 140) described herein internally routes the purged fuel vapors to desirable entry points into the air core of the intake manifold 44. The primary wall 138 contains the purge single point entry (i.e., orifice 172) while the chamber 152 between the primary wall 138 and the secondary wall 140 allows the purged fuel vapors to be routed to locations that are evenly distributed to the channel 136 via the gap 158 enabling even distribution of the purged fuel vapors to each cylinder of the engine 10.

Additional features may be included that further assist to evenly distribute the purged fuel vapors to the to the channel 136. For example, the secondary wall 140 may define a plurality of secondary channels 176 configured to route fuel vapors from the chamber 152 to the air intake channel 136. As another example, at least one seal 178 may be disposed within and configured to partially obstruct the gap 158 so that fuel vapors are directed from the chamber 152 to the air intake channel 136 through spaces between the seals 178. The secondary channels 176 and/or the spaces between the seals 178 may be spaced-apart to evenly distribute the purged fuel vapors from the chamber 152 and to the channel 136.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A vehicle comprising:

an engine configured to propel the vehicle;

a fuel tank configured to store fuel;

a canister in fluid communication with the fuel tank and configured to receive and store evaporated fuel from the fuel tank;

an intake manifold configured to direct air to the engine and having an inlet conduit that defines a channel configured to receive air from a throttle, wherein the inlet conduit has a (i) primary wall partially defining the channel and (ii) a secondary wall partially defining the channel, wherein the secondary wall overlaps and is offset from a first portion of the primary wall such that (a) a chamber is defined between a radially outward facing surface of the secondary wall and a radially inward facing surface of the primary wall along the first portion of the primary wall and (b) a gap is defined between an outer periphery of the secondary wall and a second portion of the primary wall, and wherein the gap establishes fluid communication between the chamber and the channel;

a purge valve disposed between the canister and the intake manifold;

a purge conduit configured to establish fluid communication between the purge valve and the chamber; and a controller programmed to, in response to a command to purge the canister of evaporated fuel, open the purge valve and direct the evaporate fuel to the chamber via the purge conduit.

2. The vehicle of claim 1, wherein the gap is defined along a front edge and side edges of the secondary wall.

3. The vehicle of claim 1, wherein a radially inward facing surface of the secondary wall is flush with a portion of the radially inward facing surface of the primary wall that extends along the second portion of the primary wall.

4. The vehicle of claim 1, wherein the first portion of the primary wall is offset from the second portion of the primary wall such that a radially outward extending recess is defined by the first portion of the primary wall.

5. The vehicle of claim 4, wherein the secondary wall is disposed within the radially outward extending recess.

6. The vehicle of claim 1, wherein the secondary wall is disposed along a lower half of the channel.

7. The vehicle of claim 1, wherein the inlet conduit defines an orifice configured to establish fluid communication between a fuel evaporative storage canister and the chamber.

8. An intake manifold for an engine comprising:

a conduit having a primary wall partially defining an air intake channel;

a throttle body mounting flange (i) protruding radially outward from an end of the conduit, (ii) defining an opening to the air intake channel, and (iii) configured to receive a throttle body for installation thereon; and a secondary wall partially defining the air intake channel and offset from the primary wall such that (i) a chamber is defined between an exterior side of the secondary wall and an interior side of the primary wall and (ii) a gap is defined between outer edges of the secondary wall and inner edges of the primary wall, wherein the gap establishes fluid communication between the chamber and the channel, and wherein the conduit defines an orifice configured to establish fluid communication between a fuel evaporate storage canister and the chamber.

9. The intake manifold of claim 8, wherein the gap is defined along a front edge and side edges of the secondary wall.

10. The intake manifold of claim 8, wherein an interior side of secondary wall is flush with a portion of the interior side of the primary wall.

11. The intake manifold of claim 8, wherein the secondary wall is disposed along a lower half of the air intake channel.

12. The intake manifold of claim 8, wherein the secondary wall defines a plurality of secondary channels configured to route fuel vapors from the chamber to the air intake channel.

13. The intake manifold of claim 8, wherein at least one seal is disposed within and configured to partially obstruct the gap.

14. An intake manifold for an engine comprising:

an air inlet port having an interior surface partially defining a channel; and a false wall partially defining the channel, wherein (i) the false wall is flush with the interior surface, (ii) a chamber is defined on an opposing side of the false wall relative to the channel, (iii) a gap is defined between outer edges of the false wall and the interior surface, (iv) the gap establishes fluid communication between the chamber and the channel, and (v) the air inlet port defines an orifice configured to establish fluid communication between a fuel evaporate recovery system and the chamber.

15. The intake manifold of claim 14, wherein the gap is defined along a front edge and side edges of the false wall.

16. The intake manifold of claim 14, wherein the interior surface defines a radially outward extending recess.

17. The intake manifold of claim 16, wherein the false wall is disposed within the radially outward extending recess.

18. The intake manifold of claim 14, wherein the false wall is disposed along a lower half of the channel.

19. The intake manifold of claim 14, wherein the false wall defines a plurality of secondary channels configured to route fuel vapors from the chamber to the channel.

20. The intake manifold of claim 14, wherein at least one seal is disposed within and configured to partially obstruct the gap.

* * * * *